US010639239B2

(12) United States Patent
Clores

(10) Patent No.: US 10,639,239 B2
(45) **Date of Patent: *May 5, 2020**

(54) BOTTLE HOLDING SYSTEM AND CONFIGURATIONS THEREOF

(71) Applicant: Edgardo Clores, Las Vegas, NV (US)

(72) Inventor: Edgardo Clores, Las Vegas, NV (US)

(73) Assignee: MACE CORPORATION, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/426,899

(22) Filed: Feb. 7, 2017

(65) Prior Publication Data

US 2018/0036206 A1 Feb. 8, 2018

Related U.S. Application Data

(63) Continuation-in-part of application No. 15/226,771, filed on Aug. 2, 2016, now abandoned.

(51) Int. Cl.
*A61J 9/06* (2006.01)

(52) U.S. Cl.
CPC ..... *A61J 9/0638* (2015.05); *A61J 9/0661* (2015.05); *A61J 9/0684* (2015.05)

(58) Field of Classification Search
CPC ..... A61J 9/0638; A61J 9/0684; A61J 9/0661
USPC ..... 248/102, 103, 104, 105, 106
See application file for complete search history.

(56) References Cited

U.S. PATENT DOCUMENTS 493,305 A * 3/1893 Sherman ..... F04D 29/601 135/138
743,914 A * 11/1903 McMurran ..... A61J 9/06 248/106
760,389 A * 5/1904 Eba ..... A61J 9/06 248/106
1,030,744 A * 6/1912 Neumann ..... A61J 9/06 248/102
1,187,845 A * 6/1916 Kolb ..... A61J 9/06 248/102
1,220,266 A * 3/1917 Ott ..... A61J 9/06 248/103
1,287,125 A * 12/1918 Smith ..... A61J 9/06 248/102
1,301,886 A * 4/1919 Toeknell ..... A61J 9/06 248/102
1,340,974 A * 5/1920 O'Reilly ..... A47G 23/0241 248/105
1,501,080 A * 7/1924 Wickham ..... A61J 9/0638 248/102
1,753,875 A * 4/1930 Baumann ..... A61J 9/0638 248/103
1,788,267 A * 1/1931 Amaral ..... A47B 23/02 108/49

(Continued)

FOREIGN PATENT DOCUMENTS

GB 2170410 A 8/1986
GB 2187391 A 9/1987
GB 2457475 A 8/2009

*Primary Examiner* — Kimberly T Wood
(74) *Attorney, Agent, or Firm* — Weiss & Moy, P.C.; Jeffrey D. Moy

(57) ABSTRACT

A bottle holding system for a baby device has a frame assembly having a beam. An attachment is inserted through the beam and securing a bottle on the beam.

12 Claims, 18 Drawing Sheets

(56) References Cited

U.S. PATENT DOCUMENTS 1,826,810 A * 10/1931 Morishita ..... A61J 9/0638 248/102
1,863,163 A * 6/1932 Malti ..... A61J 9/0638 248/102
2,015,280 A * 9/1935 Morishita ..... A47B 23/007 248/103
2,514,134 A * 7/1950 Mann ..... A61J 9/0661 248/102
2,529,173 A * 11/1950 Moyer ..... A47C 21/00 24/132 R
2,638,296 A * 5/1953 Battle ..... A61J 9/0684 248/105
2,639,111 A * 5/1953 Wells ..... A61J 9/0684 248/105
2,647,714 A * 8/1953 Drill ..... A61J 9/0638 248/106
2,681,782 A * 6/1954 Morishita ..... A61J 9/0692 248/106
2,738,152 A * 3/1956 Blackmore ..... A61J 9/0661 248/103
2,739,320 A * 3/1956 Kostka ..... A47D 15/02 24/299
2,931,608 A * 4/1960 Farah ..... A61J 9/0638 248/106
2,944,779 A * 7/1960 Silagyi ..... A61J 9/0661 248/103
3,120,368 A * 2/1964 Crisp ..... A61J 9/0661 248/103
3,539,140 A * 11/1970 Tuttle ..... A61J 9/0661 248/104
4,121,797 A * 10/1978 MacNeil ..... A61J 9/0638 248/102
4,733,837 A 3/1988 Aguirre
D312,195 S * 11/1990 Ahlerich ..... D8/14
5,037,046 A * 8/1991 Mingledorff, Jr. .... A61J 9/0638 248/106
5,092,549 A * 3/1992 Beech ..... A61J 9/0661 248/103
D403,427 S * 12/1998 Pring ..... D24/199
5,937,766 A * 8/1999 Denny ..... B25H 5/00 108/143
7,063,651 B2 * 6/2006 Kerry ..... A63B 69/0057 482/140
7,143,985 B2 * 12/2006 Barnes ..... A61J 9/0661 248/106
7,188,810 B1 * 3/2007 Lasky ..... A61J 9/0661 248/103
7,857,734 B2 * 12/2010 Miller ..... A63B 69/201 212/270
8,261,509 B2 * 9/2012 Harkin ..... E04G 23/0218 248/354.1
2009/0127896 A1 * 5/2009 Madden ..... B62B 9/00 297/188.01

* cited by examiner

BOTTLE HOLDING SYSTEM AND CONFIGURATIONS THEREOF

RELATED APPLICATIONS

This disclosure is a continuation-in-part of U.S. patent application Ser. No. 15/226,771 filed on Aug. 2, 2016, titled "Bottle Holding System and Configurations Thereof", and further to U.S. patent application Ser. No. 15/331,014 filed on Oct. 21, 2016, titled "Bottle Holding System and Configurations Thereof" both by Edgardo Clores and both expressly incorporated herein by reference in its entirety.

TECHNICAL FIELD

This disclosure generally relates to a bottle holder, and more particularly, to a transportable structure having an attachment for securing a baby bottle.

BACKGROUND

On average, newborns feed every two to three hours consuming about two to three ounces at each feeding. Feedings may occur seven to nine times a day. The frequency of feedings may be reduced as the baby grows and takes more at each feeding. Unfortunately, bottle feedings may cause physical strains to caregivers as bottles may be held in demanding positions for long and frequent periods of time. Caregivers may experience strain on their back, shoulder and wrists when holding the bottle. Furthermore, the caregivers may have other tasks or chores to complete and cannot dedicate enough time for those feedings.

A number of baby bottle holders currently exist in the market. However, they are not adaptable to various positions that a baby may take during their feedings. For example, the baby may change positions with respect to the holder making the bottle unusable due to angle constraints. These holders may be inconvenient to setup and relocate them to different locations. Furthermore, feedings often take place in a baby carrier for which no holder exists.

The present disclosure provides a bottle holding system that solves each of the described concerns. The bottle holding system described herein may be easily transportable and adapted to different feeding positions and styles of babies. The system may also be placed in a baby carrier. Other benefits and advantages will become clear from the disclosure provided herein and those advantages provided above are for illustration.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with one aspect of the present disclosure, a bottle holding system for a baby device is provided. The bottle holding system has a frame assembly having a beam. An attachment is inserted through the beam and securing a bottle on the beam.

In accordance with another aspect of the present disclosure, a feeding system for a baby device is provided. The feeding system has a structure having a beam, wherein a length of the beam is adjusted based on the baby device. An attachment is inserted through the beam and securing a baby bottle to the baby device.

BRIEF DESCRIPTION OF DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

The present disclosure relates to a bottle holding system and provides multiple configurations to that system. More particularly, this disclosure describes a structure for securing and slanting a baby bottle to a correct feeding position on a baby carrier. In one illustrative embodiment, the structure may be formed from a first side member and a second side member parallel to each other with a beam formed between them. The length of the beam may be adjusted based on the baby carrier. The side members may support the beam for an attachment hooked thereto. The attachment may include a bottle engaging section for holding a baby bottle. The attachment may pivot providing the correct feeding position.

Numerous other modifications or configurations for the bottle holding system will become apparent from the description provided below. Advantageously, the structure of the bottle holding system may provide support for the attachment having the bottle engaging section. The structure may stabilize the attachment when a baby grabs onto portions of the structure and shakes or rattles it. The system may be easily put together and taken apart for transportation from one place to another. Furthermore, a variety of baby carriers may use the system. Other advantages will become apparent from the description provided below.

Figure 1:
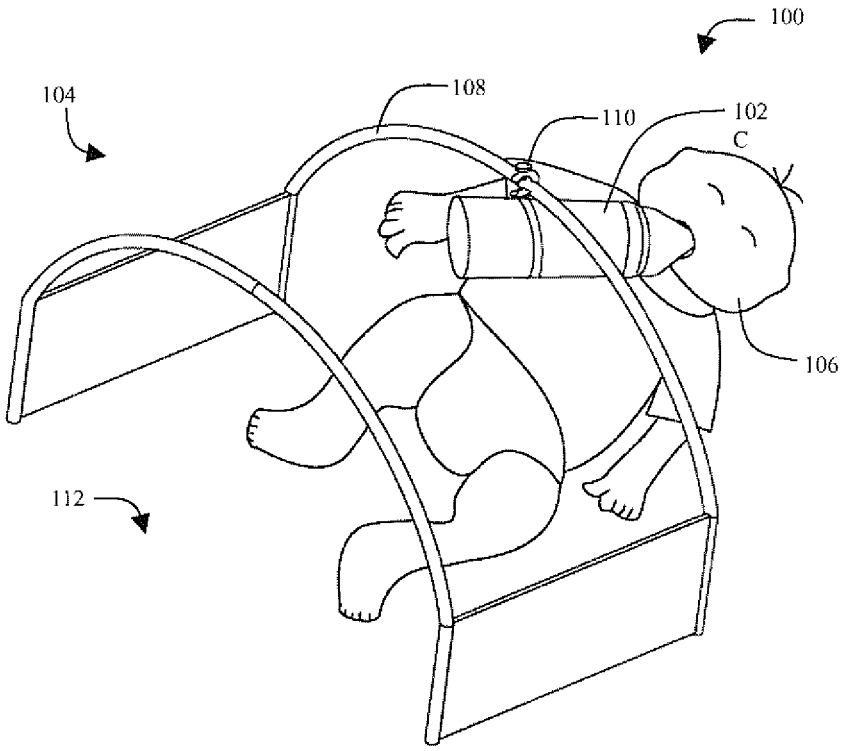
FIG. 1 is an exemplary system for securing a bottle depicted in an illustrative environment in accordance with one aspect of the present disclosure.
Figure 2:
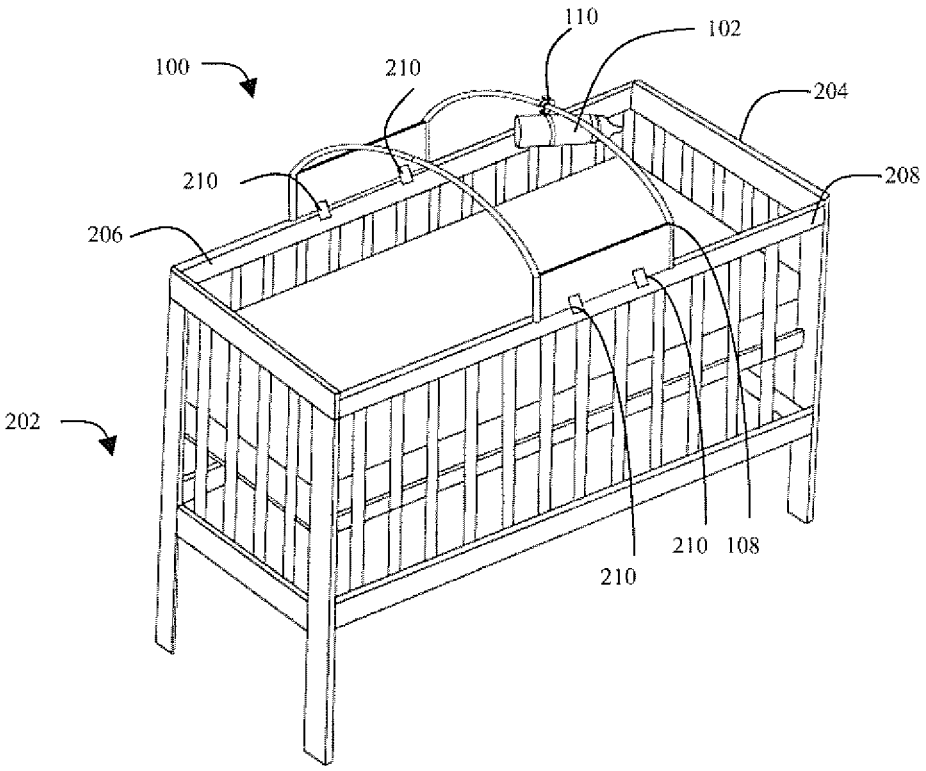
FIG. 2 is the exemplary system in another illustrative environment in accordance with one aspect of the present disclosure.
Figure 13:
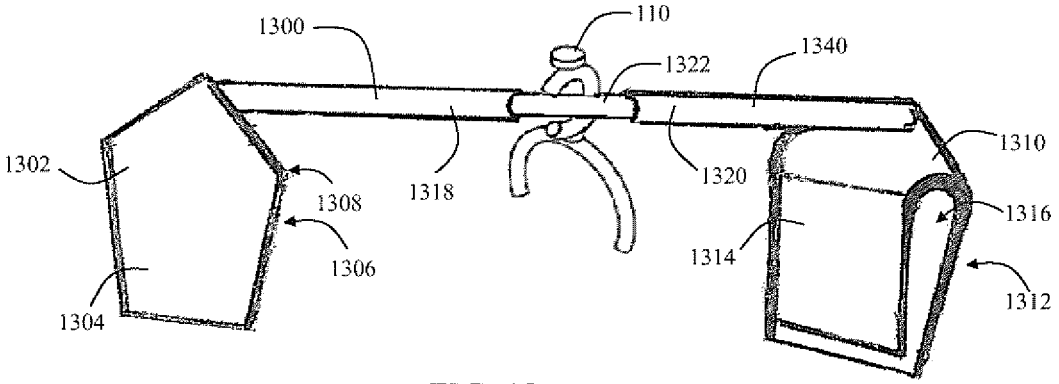
FIG. 13 is a side perspective view of another exemplary system for securing a bottle to a baby carrier in accordance with one aspect of the present disclosure.
Figure 14:
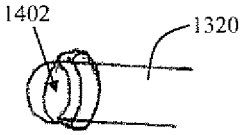
FIG. 14 is a closer view of a side section of the exemplary system for securing the bottle to the baby carrier in accordance with one aspect of the present disclosure.
Figure 15:
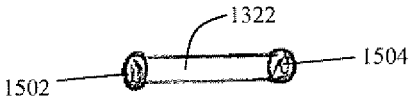
FIG. 15 is a closer view of a middle section of the exemplary system for securing the bottle to the baby carrier in accordance with one aspect of the present disclosure.

The present disclosure will disclose multiple environments for the system in FIGS. 1 and 2, followed by a description of the structure of the system with a first attachment in FIGS. 3 through 6. A second attachment along with additional details regarding the structure will be shown in FIGS. 7 through 12. FIGS. 13 through 15 will describe a bottle holding system for a baby carrier. FIGS. 16 through 20 introduce a third attachment.

Turning now to FIG. 1, an exemplary system 100 for securing a bottle 102 depicted in an illustrative environment 104 in accordance with one aspect of the present disclosure is provided. The shown environment 104 provides for one embodiment where a baby 106 lies flat on their back to feed, which is typically associated with newborns or infants. The system 100 may be used in a number of different environments which will become apparent from the description provided below.

The structure 108 of the system 100 may be placed on a ground 112, or other flat surface. The system 100 may also be placed into a playpen, crib, mattress, bassinet, or the like. As shown, the structure 108 may be placed over the baby 106. A portion of the structure 108 may be positioned over an upper torso of the baby 106 in the shown embodiment. The structure 108 may be set at different angles or placements for the baby 106 to adjust to each baby's feeding preferences.

A width of the structure 108 may be predefined or adjustable. Typically, the width surrounds the baby's body. The length of the structure 108 may vary depending on the baby 106. For example, the length may extend past the baby's legs such that the baby 106 does not knock the structure down. The length and width of the structure 108 may be determinative factors for providing stability to the structure 108.

The height of the structure 108 may be set such that enough clearance is given for the baby 106 to properly feed. The height may incorporate the clearance for different positions of the bottle 102 including the allowance of pivot movements by a first attachment 110. In one embodiment, the height of the structure 108 may be increased or decreased depending on the environment and the baby 106.

The first attachment 110 may hold the bottle 102 above the baby's head to allow the baby 106 to feed. In one embodiment, the structure 108 along with the attachment 110 may allow the baby 106 to feed without using their hands. The length of the attachment 110, as will be shown, may be adjusted such that different heights for the bottle 102 may be implemented.

In one embodiment, the structure 108 may include fasteners on a bottom section to prevent the structure 108 from being tipped or toppled over by the baby 106. The fasteners may secure the system 100 to the ground 112, playpen, crib, mattress, bassinet, or the like. The fasteners may include, but are not limited to, hook and loop fasteners, snap-on fasteners, buttons, zippers, pins, clips, or the like to secure the structure 108.

The system 100 may be used in other environments, for example, when the baby 106 begins to stand on their own. FIG. 2 is the exemplary system 100 in another illustrative environment 202 in accordance with one aspect of the present disclosure. The system 100 may be placed onto a crib 204, or the like, allowing a baby 106 to stand while feeding from the bottle 102. While the environment 202 shows the system 100 within a crib 204, other types of devices may be used to increase the height of the structure 108.

The system 100 may be attached to the crib 204 at a first side 206 and second side 208. The height of the structure 108 may be adjusted according to the baby's height. This may include additional height or clearance for the first attachment 110 having the bottle engaging section. The bottle 102 may be pivoted by the baby 106 for a correct feeding position through the attachment 110.

A number of fasteners 210 may be used to couple the system 100 to the crib 204. For example, clamps, clasps, locks, and other connectors may be used as the fasteners 210. Multiple fasteners 210 may be used for the system 100. Typically, the fasteners 210 may be positioned on an outside portion of the structure 108. The fasteners 210 may provide support such that the system 100 does not become loose when the baby 106 shakes or moves it.

Figure 3:
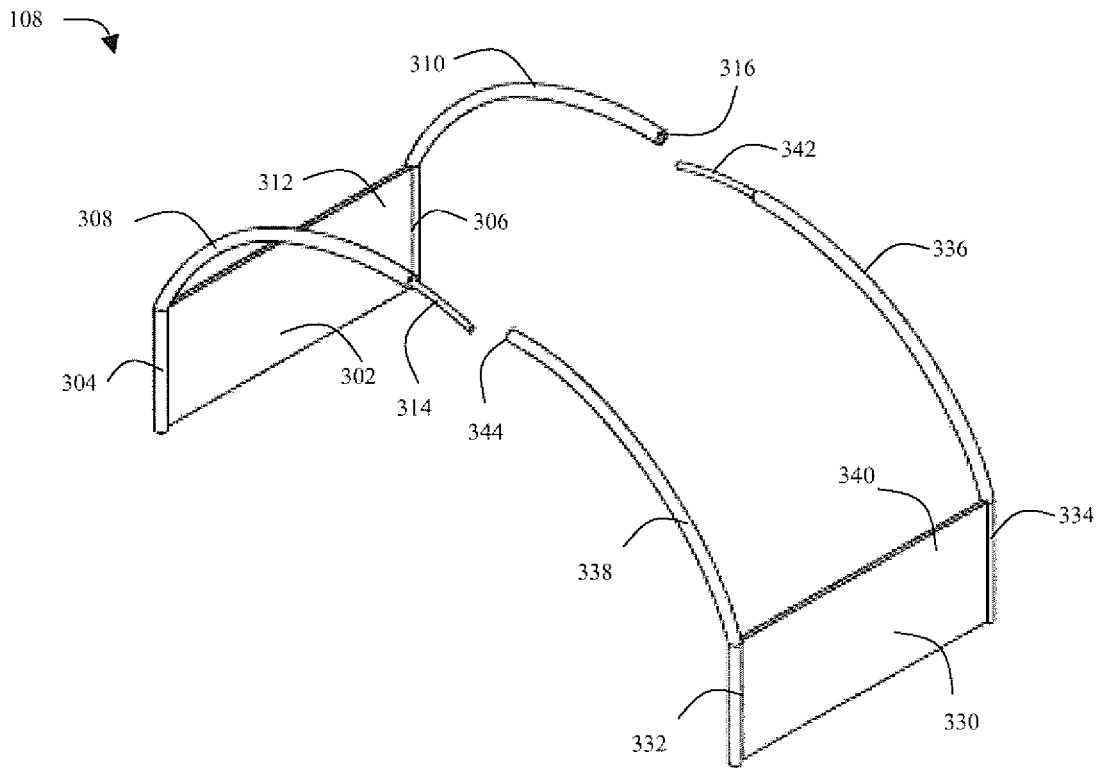
FIG. 3 is a top perspective view of an illustrative structure for the exemplary system separated into individual components in accordance with one aspect of the present disclosure.

FIG. 3 is a top perspective view of an illustrative structure 108 for the exemplary system 100 separated into individual components in accordance with one aspect of the present disclosure. Specifically, the structure 108 includes a first member 302 and a second member 330 to provide the support and stability to feed the baby 106. Fewer or more components may be provided within the structure 108 and are not limited to those shown.

Beginning with the first member 302, the member 302 may include a rectangular section 312 surrounded by a first side end 304 and a second side end 306. The section 312 may be made of a rigid material such as hard plastic or metal. The section 312 may include graphics on an inward looking position to entertain the baby 106. In one embodiment, reflective materials or a mirror may be placed on the section 312. Toys or other device may be provided on the section 312 to also entertain the baby 106 while feeding.

The rectangular section 312, as well as the side ends 304 and 306, may be as tall as the baby's body. The height may be set at different clearance for the baby's head. The height may be adjustable through extensions. The extension may include extendable and retractable segments coming in and out of the side ends 304 and 306. In one embodiment, extensions for the height of the structure 108 may be provided through connections to the rectangular section 312.

Continuing with FIG. 3, a first rod 308 coming out of the first side end 304 and a second rod 310 coming out of the second side end 306 is shown. The first rod 308 and second rod 310 may be made of rigid materials such as plastic, metal or other material. The rods 308 and 310 may bend towards the second member 330 when combined together. The first rod 308 and second rod 310 of the first member 302 may cover half the distance used by the structure 108 that surrounds the baby 106, as described above.

In one embodiment, the first rod 308 and second rod 310 may be placed into the first side end 304 and second side end 306. The side ends 304 and 306 may be hollowed such that the rods 308 and 310 may be slid into place. The rods 308 and 310 may be easily inserted or removed from the side ends 304 and 306 for assembly. Alternatively, the first rod 308 and second rod 310 may be permanently attached to the side ends 304 and 306.

The first rod 308 on the first member 302 may include a first connector point 314. The first connector point 314 may fit into a second connector point 344 on a second rod 338 of the second member 330. The first connector point 314 may include a male connector and the second connector point 344 may include a female connector to provide support for the structure 108. When fit together, the male and female connector may provide enough strength to the structure 108 to overcome shakes and rattles to the structure 108 by the baby 106.

The first rod 308 of the first member 302 and the second rod 338 of the second member 330 may include other types of fasteners to secure them together absent the first connector point 314 and the second connector point 344. For example, hook and loop fasteners may be placed on each of the rods 308 and 338. In one embodiment, a plastic sleeve may be fit onto the first rod 308 or second rod 338 and slipped onto the other rod to connect them together.

In the shown embodiment, a second connection may be made to provide support for the structure 108. The second rod 310 on the first member 302 may include a second connector point 316. The second connector point 316 may fit into a first connector point 342 on a first rod 336 of the second member 330. The second connector point 316 may include a female connector and the first connector point 342 may include a male connector to provide support for the structure 108. Variations for this connection may be used, as detailed above. Through both connections, stronger support may be provided to the structure 108.

Similar to the first member 302, the second member 330, briefly mentioned above and now provided with more detail herein, may include a rectangular section 340 with a first side end 334 and second side end 332. The first side end 334 may be connected to first rod 336 and the second side end 332 may be connected to the second rod 338. These components may have the same configurations and embodiments as described above in relation to the first member 302. The second member 330 may include the first rod 336 and second rod 338 with the second connector point 344 and the first connector point 342 shown above for coupling the first rod 308 and second rod 310 of the first member 302 to provide a stable and durable structure 108.

As shown, the structure 108 thus includes a first rod 308 and second rod 310 on the first member 302 tethered to a second rod 338 and first rod 336 on the second member 330. By mating the rods 308, 310, 336 and 338, a stable and rigid structure is formed to withstand the forces created by a baby 106. The rods 308, 310, 336 and 338 themselves extend in a vertical direction and end at a horizontal direction when coupled to one another to form the structure 108. When connected, the rods 308, 310, 336 and 338 form a plurality of beams.

Figure 4:
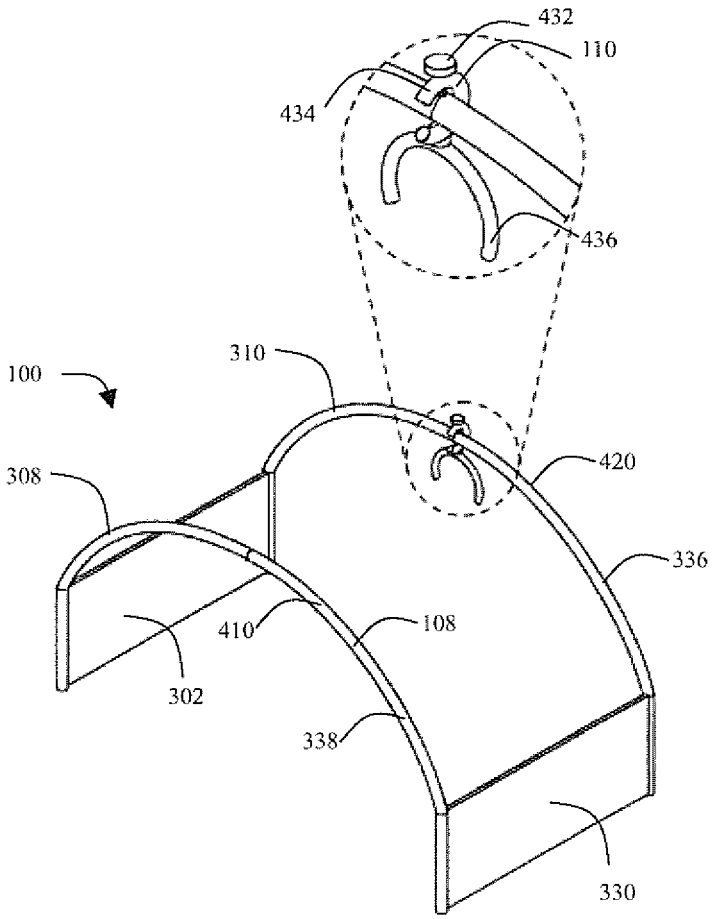
FIG. 4 is a top perspective view of the exemplary system with an illustrative attachment securing the bottle in accordance with one aspect of the present disclosure.

FIG. 4 is a top perspective view of the exemplary system 100 with an illustrative attachment 110 securing the bottle 102 in accordance with one aspect of the present disclosure. To support the first attachment 110, at least one beam 410 or 420 may be provided by the structure 108. While two beams 410 and 420 are shown, a single beam or more than two beams may be used. Typically, more beams may provide more integrity and stability to the structure 108 and the system 100.

The first beam 410 on the structure 108 of the system 100 may be formed from the first member 302 and second member 330. In one embodiment, and as shown, the rod 308 on the first member 302 may be coupled together with the second rod 338 of the second member 330. Female and male connectors were shown earlier, however, other types of connections may be used and are not limited to those. The first beam 410, through the rods 308 and 338, may begin vertically from their respective members 302 and 330, and bend horizontally intersecting at a midpoint where the connection occurs. The arch may provide support to the structure 108.

The second beam 420 of the structure likewise may be formed from the first member 302 and second member 330. A second rod 310 of the first member 302 may be connected to the first rod 336 of the second member 330. Female and male connectors may be used along with other types and is not limited to those disclosed above. The second beam 420 formed from the second rod 310 and the first rod 336 may include a similar arch as the first beam 410.

The first beam 410 or second beam 420, as shown in FIG. 4, may support the first attachment 110. The attachment 110, in one embodiment, may pivot to adjust a feeding position of the bottle 106. While shown earlier as a single swinging position, the attachment 110 may allow for the bottle 106 to be rotated at different angles and swing up and down along the second beam 420.

The first attachment 110 may include a number of components including, but not limited to, a bolt 432, hook 434 and clasp 436. The attachment 110 is shown as one example and should not be construed as limiting. A second attachment will be shown below and additional or fewer components may be taken between them to provide a variety of combinations of attachments.

The bolt 432 of the first attachment 110 may be used to secure the attachment 110 to the second beam 420. The bolt 432 may be untightened and tightened to release or secure the attachment 110, for example, through a screw and threading. Other types of mechanisms may be used to secure the attachment 110 to the beam 420.

The hook 434 may allow the first attachment 110 to be placed onto the beam 420, with the bolt 432 securing the hook 434 into place on the beam 420. The hook 434 has an opening allowing it to be slipped onto the beam 420. Connected to the hook 434 may be the clasp 436. Each attachment, shown herein, may include a bottle engaging section, and as shown may be the clasp 436 according to one embodiment. The clasp 436, as the bottle engaging section, may grip a bottle 102 into place. Various types of clasps 436 may be used depending on the different types of configurations for the bottle 102. The bottles 102 may be of various sizes and shapes.

In one embodiment, the distance between the hook 434 and the clasp 436 may vary. Spacing between them may allow for the clasp 436 to be lowered. The spacing may be adjusted depending on the baby 106. Simple extensions may be used, for example, the extension would be placed between the bottom of the hook 434 and the top of the clasp 436 without welding the two together.

The hook 434 may be secured to the beam 420 through the bolt 432 which may prevent movement of the first attachment 110 from swinging up and down the beam 420 as shown above. The bottle 102 held by the clasp 436 would also be stationary. Alternatively, the hook 434 may pivot along the beam 420 allowing the attachment 110 to swing up and down. Through the pivoting motion different angles may be provided for feeding the baby through the bottle 102 attached to the clasp 436. In one embodiment, the clasp 436 may also rotate at its top portion thus allowing the bottle 102 to move up and down and left and right for an optimal feeding position.

Figure 5:
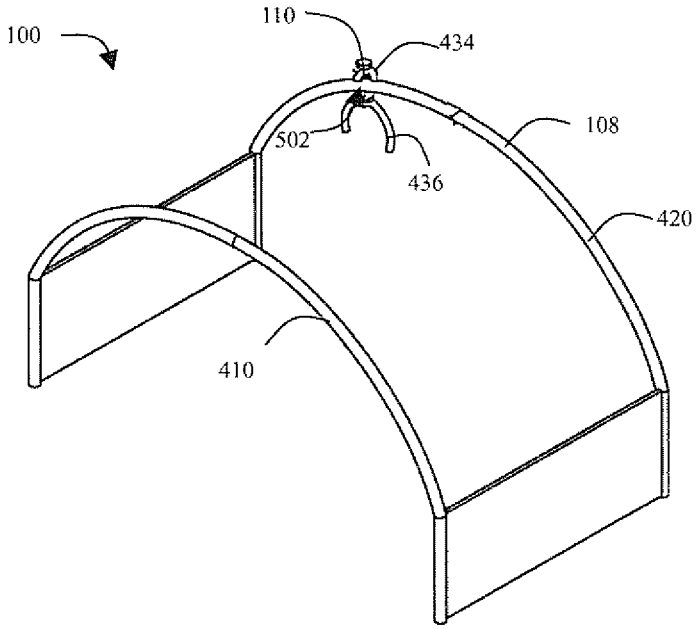
FIG. 5 is a top perspective view of the exemplary system with the illustrative attachment positioned at a non-centralized location in accordance with one aspect of the present disclosure.

FIG. 5 is a top perspective view of the exemplary system 100 with the illustrative attachment 110 positioned at a non-centralized location in accordance with one aspect of the present disclosure. Beforehand, the first attachment 110 was set at a center point of the second beam 420, however, the attachment 110 may be placed along a number of different points along the structure 108 including the first beam 410 and the second beam 420.

A secondary point 502 may be used to secure the first attachment 110. As provided earlier, the bolt 432 of the attachment 110 may be lowered or raised thereby securing the attachment 110 to the point 502. A bottle 102 may be attached to the clasp 436 and provide a different feeding position or angle for the baby 106. The bottle 102 may be adjusted also such that it may pivot up, down, left and right through those mechanisms described above.

Figure 6:
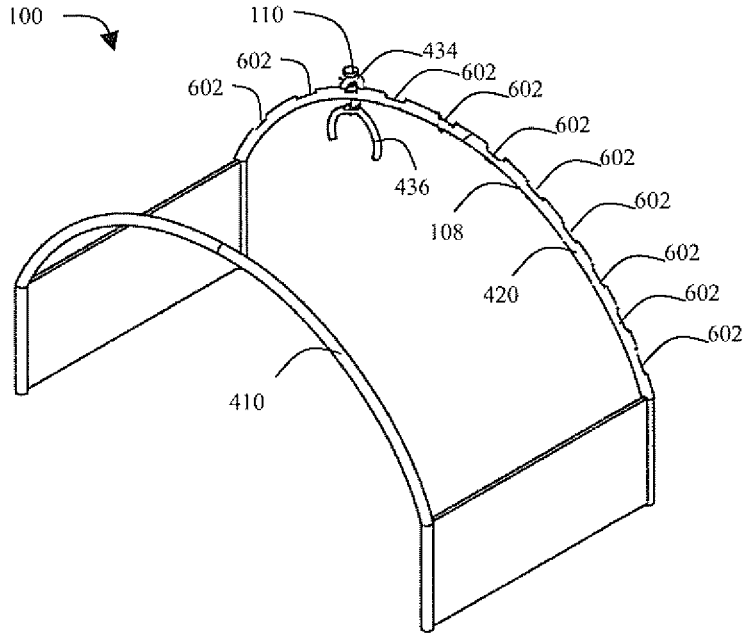
FIG. 6 is a top perspective view of the exemplary system depicting grooves to hold the illustrative attachment into place in accordance with one aspect of the present disclosure.

FIG. 6 is a top perspective view of the exemplary system 100 depicting grooves 602 to hold the illustrative attachment 110 into place in accordance with one aspect of the present disclosure. To provide an additional securing mechanism, the attachment 110 may be positioned at one groove 602 along the second beam 420. The grooves 602, in one embodiment, may vary depending on their position on the beam 420. For example, the closer the groove 602 towards the ends of the beam 420, the deeper the groove 602 would be. This may allow for better securement of the hook 434 with the clasp 436 to the beam 420. In one embodiment, the grooves 602 may be located on the first beam 410.

Figure 7:
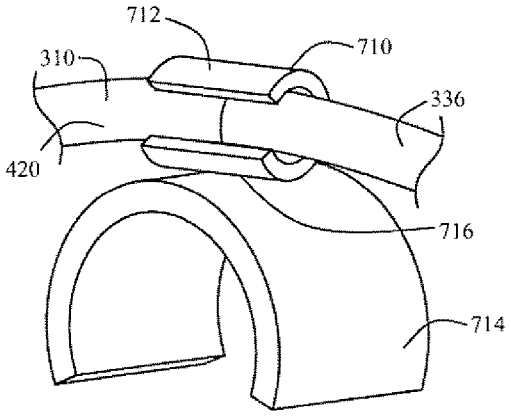
FIG. 7 is a side perspective view of another illustrative attachment for the exemplary system in accordance with one aspect of the present disclosure.

Referring to FIG. 7, a side perspective view of another illustrative attachment 710 for the exemplary system 100 in accordance with one aspect of the present disclosure is provided. While shown as a single attachment connected to the beam 420, the structure 108 may support more than one attachment. The second attachment 710 may include, but is not limited to, a clamp 712 and catch 714, or bottle engaging section, held together by a weld 716.

The second attachment 710, similar to the first attachment 110, may be positioned along the second beam 420, as shown created by the second rod 310 of the first member 302 and the first rod 336 of the second member 330, or along other beams on the structure 108. The grooves 602, shown earlier, may be used to tightly secure the attachment 710 into place including the center of the beam 420 or along different positions on the beam 420.

The clamp 712 of the second attachment 710 may also provide strength to the second beam 420. The clamp 712, being wider than the hook 434 of the first attachment 110, may provide a secure hold of the second rod 310 to the first rod 336. The clamp 712 may have an opening where it may be inserted over the beam 420. In this way, a user may slip the clamp 712 over the beam 420 and a firm hold may be made.

In embodiments, the hook 434 and clamp 712 may be entirely encircled. In order for the completely encircled hook 434 or clamp 712 to be attached to the second beam 420, the second rod 310 and the first rod 336 may be disconnected and the hook 434 or clamp 712 would be slid onto it and the second rod 310 and the first rod 336 would be reconnected. Thereafter, the hook 434 or clamp 712 would be positioned. The encircled hook 434 or clamp 712 may also be placed on the first beam 410 through similar techniques. Advantageously, the first attachment 110 or second attachment 710 may be held to the structure 108 more securely.

Connected to the clamp 712 may be the catch 714 at a lower portion of the second attachment 710. The weld 716 may be a physical weld or other type of connection that keeps the two together. An extension may be used that may vary the distance between the clamp 712 and the catch 714.

The catch 714, noticeably larger in width than the clasp 436 of the first attachment 110, may be used to hold the bottle 102 for the baby 106. This bottle engaging section may hold the bottle 102 that varies in dimensions and size. The bottle engaging sections, including the clasp 436 and the catch 714, may be interchanged with one another in the first attachment 110 and second attachment 710. For example, the hook 434 of the first attachment 110 may be paired with the catch 714 of the second attachment 710. The clamp 712 of the second attachment 710 may be paired with the clasp 436 of the first attachment 110.

In embodiments, the clasp 436 or catch 714 may be fully encircled. The bottle 102 may be fitted through one side of the clasp 436 or catch 714. The fully encircled clasp 436 or catch 714 may allow for a stronger hold on the bottle 102.

Figure 8:
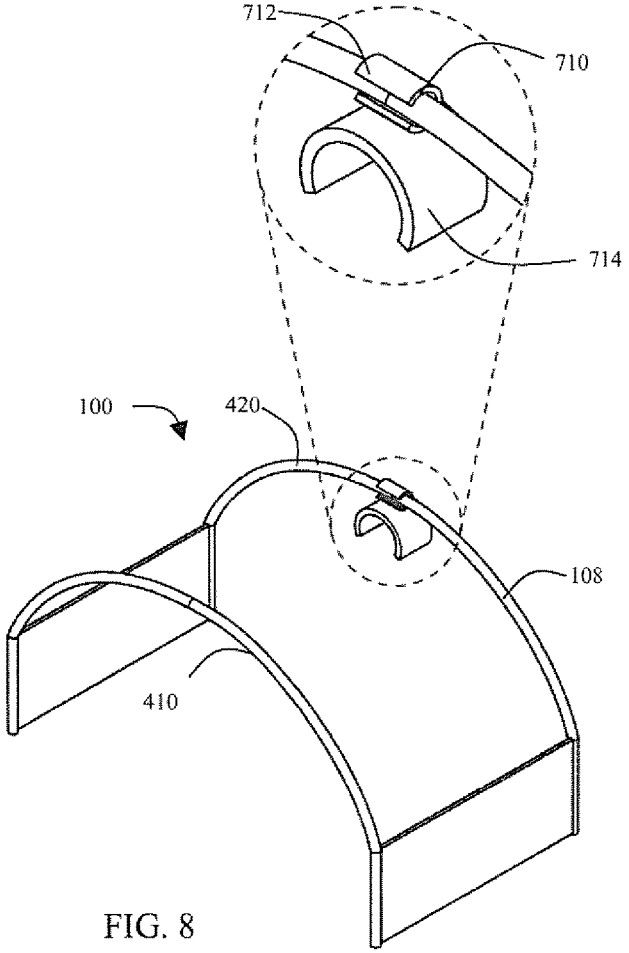
FIG. 8 is a top perspective view of the exemplary system having the other illustrative attachment in accordance with one aspect of the present disclosure.

FIG. 8 is a top perspective view of the exemplary system 100 having the other illustrative attachment 710 in accordance with one aspect of the present disclosure. Grooves 602, as shown above, may be included on the first beam 410, second beam 420 or both. The perspective view shows that the clamp 712 may be tied to the center of the second beam 420 for the structure 108 of the system 100 with the catch 714 below it. Other variations were provided above.

Figure 9:
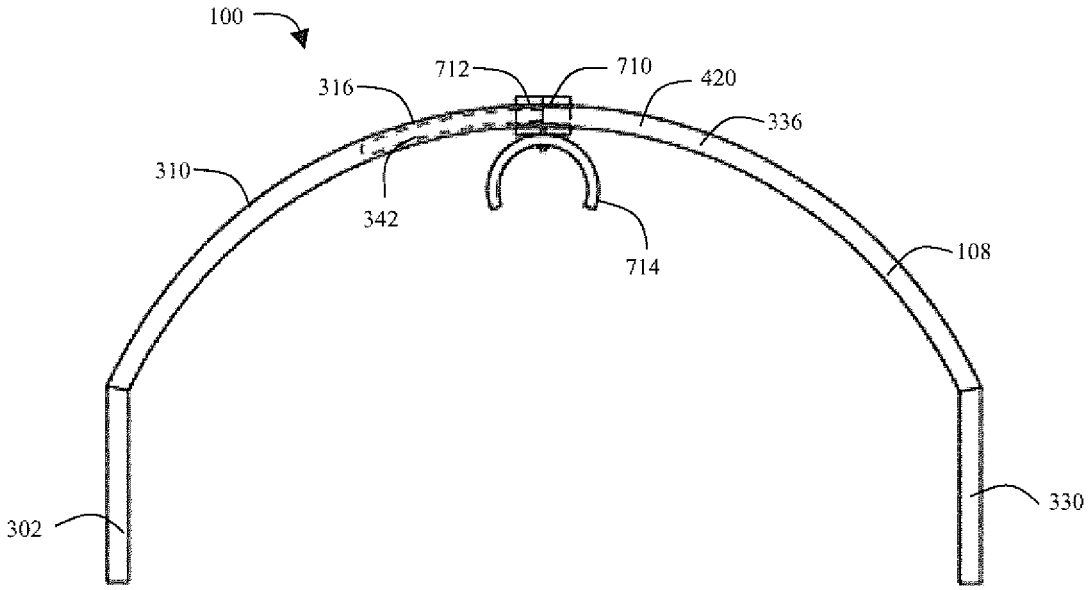
FIG. 9 is a cross sectional side view of the exemplary system in accordance with one aspect of the present disclosure.

Turning now to additional details regarding the structure 108 of the system 100, FIG. 9 is a cross sectional side view of the exemplary system 100 in accordance with one aspect of the present disclosure. The first member 302 and the second member 330 may be positioned perpendicular to the ground 112. Extending from the second side end 306 of the first member 302 may be the second rod 310 connected to a first rod 336 extending from the first side end 334 of the second member 330. The combination of the two rods 336 and 306 may form the second beam 420.

To specifically point out the connection between the two rods 310 and 336, a second connector point 316 of the second rod 310 of the first member 306 may include a female connector. When fit with the first connector point 342, a male connector, of the first rod 336 on the second member 330, a sturdy structure 108 is provided as the first connector point 342 may be surround by the second connector point 316. In one embodiment, to provide additional support for the structure 108, the clamp 712 having the catch 714 of the second attachment 710 may be used to further hold the first rod 336 and second rod 310 together.

Figure 10:
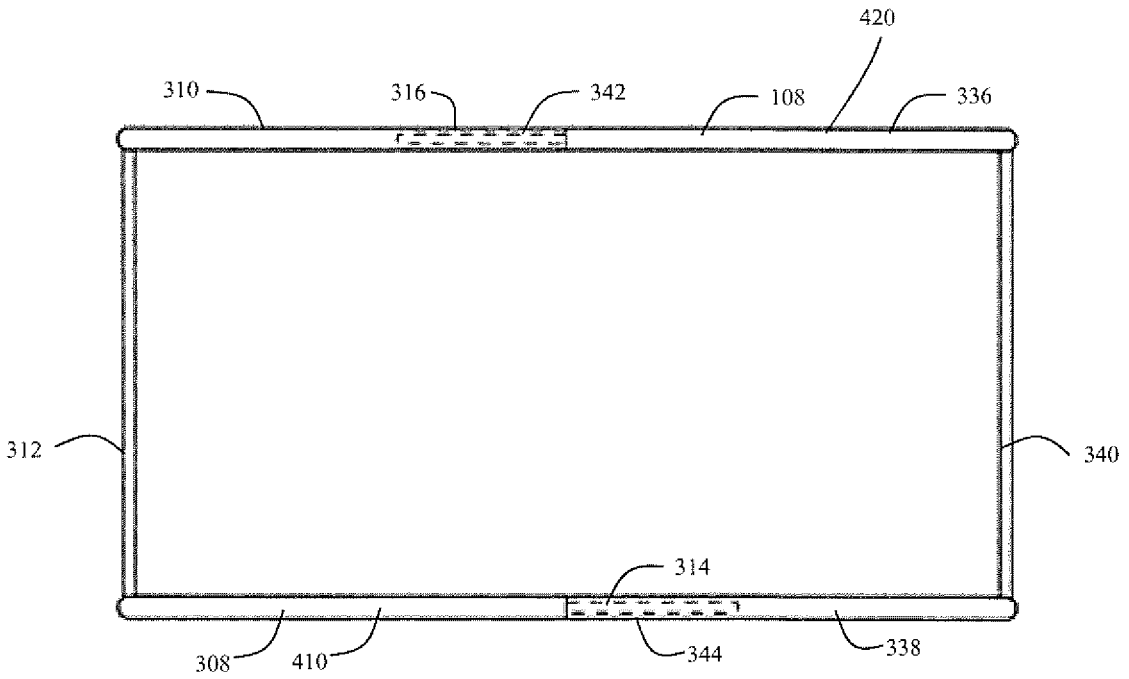
FIG. 10 is a top view of the exemplary system in accordance with one aspect of the present disclosure.

FIG. 10 is a top view of the exemplary system 100 in accordance with one aspect of the present disclosure. The rectangular section 312 on the first member 302 has the first rod 308 and second rod 310. The rectangular section 340 of the second member 330 has a first rod 336 and a second rod 338.

The first beam 410 may be formed by the first rod 308 having a first connector point 314, which may be a male connector, and the second rod 338 having the second connector point 344, which may be a female connector. The second beam 420 may be formed by the second rod 310 having a second connector point 316, which may be a female connector, and the first rod 336 having a first connector point 342, which may be a male connector. The male connectors fitted into the female connectors provide the stable structure 108.

While the first member 302 and second member 330 are shown as having both female and male connectors, the structure 108 is not limited to this configuration. For example, the first member 302 may have two male connectors while the second member 330 may have two female connectors. In one embodiment, the female and male connectors are removed for other types of fastening mechanisms such as sleeves that may be fitted over the connection points.

Figure 11:
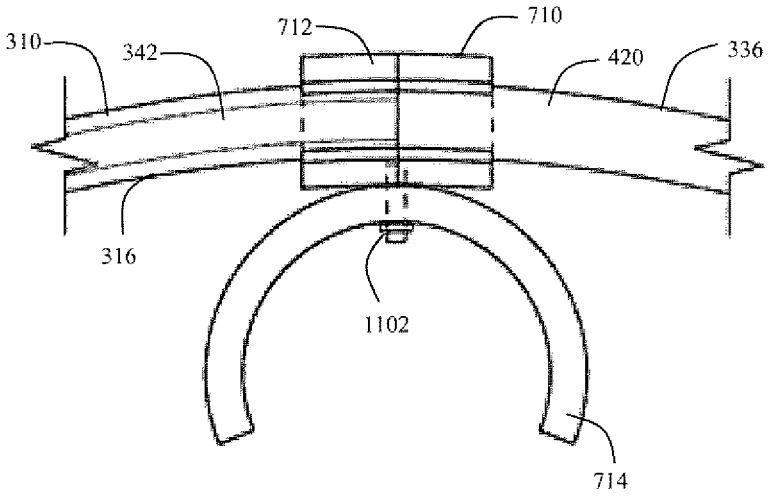
FIG. 11 is a frontal side view of the attachment in accordance with one aspect of the present disclosure.

FIG. 11 is a frontal side view of the attachment 710 in accordance with one aspect of the present disclosure. At a closer view, the first connector point 342 of the first rod 336 has been inserted into the second connector point 316 of the second rod 310 to form the second beam 420. The second attachment 710 has been placed where the first rod 336 and second rod 310 connect with one another.

As described earlier, the clamp 712 of the second attachment 710 may provide a secondary support to stabilize the structure 108. In one embodiment, the catch 714 attached to the clamp 712 may be adjusted removing the weld 716 described earlier. An adjuster 1102 may be used to reduce or enlarge the distance between the clamp 712 and the catch 714. The adjuster 1102, in one embodiment, may include a simple screw and thread component whereby to adjust the length, the catch 714 would be rotated. The adjuster 1102 may also be used in the first attachment 110 as well.

Figure 12:
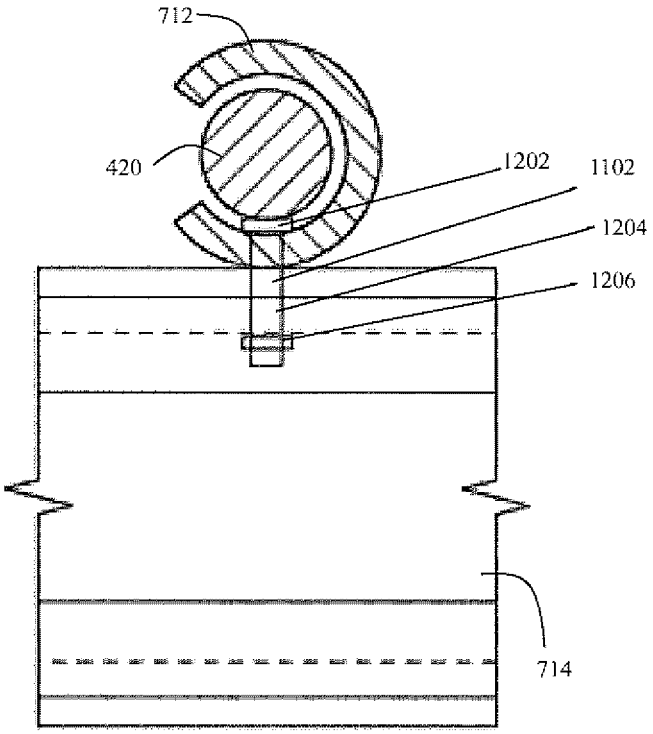
FIG. 12 is a side view of the attachment in accordance with one aspect of the present disclosure.

FIG. 12 is a side view of the attachment 710 in accordance with one aspect of the present disclosure. Provided earlier, the attachment 710 may include the clamp 712 and catch 714. The clamp 712 may surround the second beam 420. In addition, an adjuster 1102 may be used to extend or reduce the distance between the clamp 712 and catch 714.

The adjuster 1102 may include a top portion 1202, middle portion 1204 and bottom portion 1206. The top portion 1202 of the adjuster 1102 may be permanently fixed to the clamp 712 such that it does not move. The middle portion 1204 provides different lengths for adjustment and the bottom portion 1206 may be fixed to the catch 714. To adjust the length of the middle portion 1204, the catch 714 may be rotated through a screw and threading. Thus, the adjuster 1102 may allow for varying lengths between the clamp 712 and the catch 714.

FIG. 13 is a side perspective view of another exemplary system 1300 for securing a bottle 102 to a baby carrier in accordance with one aspect of the present disclosure. The shown system 1300 provides for one embodiment where a baby 106 sits within their carrier to feed. However, the system 1300 may be used in a number of different environments which will become apparent from the description provided below.

The bottle holding system 1300, in one configuration, may include a first side member 1302, a second side member 1310, and a beam 1340 extending from the first side member 1302 to the second side member 1310. The length of the beam 1340 may be adjusted based on the baby carrier. For example, the distance from one side of a baby carrier to another may vary by manufacturer. The system 1300, which may be portable, may be used for different stages of a child's life as well, i.e., as a child grows a different carrier may be used and the length of the beam 1340 may be adjusted depending on the carrier used.

The first side member 1302 of the bottle holding system 1300 may include, but is not limited to, an exterior portion 1304 and interior portion 1306 which may be coupled to one another at a top portion. The exterior portion 1304 and interior portion 1306 may be formed from a single sturdy material, such as metal, plastic or the like. A slot 1308 may be formed through the exterior portion 1304 and interior portion 1306, which will be described in further detail with respect to the second side member 1310.

The exterior portion 1304 and interior portion 1306 may form a clamp. The interior portion 1306 may be angled or slanted towards the exterior portion 1304. In one embodiment, the slant may cause the interior portion 1306 to touch the exterior portion 1304. Through the clamp, the first side member 1302 may be coupled to the baby carrier through a tight or snug fit. Other types of fasteners may be used to secure the first side member 1302 to the carrier, for example, hook and loop fasteners, bolts and nuts, strings or the like.

In one embodiment, as shown in FIG. 13, the first side member 1302, as well as the second side member 1310, may be formed in a hexagonal shape. Other shapes may be used and the side member 1302 is not limited to that shown. Furthermore, and in accordance with one embodiment, the first side member 1302 may be extendable or adjustable. The side member 1302 may increase vertically in height through a fastener or the side member 1302 itself may be allowed to increase its height. The angle at which the first side member 1302, as well as the second side member 1310, may be set may vary depending on the carrier and baby 106.

The second side member 1310 may similarly include, but is not limited to, an exterior portion 1312 and interior portion 1314 which may be coupled to one another at a top portion. The second side member 1310 may be constructed of similar materials as the first side member 1302. The exterior portion 1312 and interior portion 1314 may form a slot 1316 and form a clamp as previously described with respect to the first side member 1302, i.e., the interior portion 1314 may be angled or slanted towards the exterior portion 1312.

The second side member 1310 may also be extendable and adjustable with respect to the carrier and the baby 106, for example, vertically and angles at which the second side member 1310 may be positioned. Typically, the height and angle at which the second side member 1310 is placed and secured corresponds to the first side member 1302.

The first side member 1302 and the second side member 1310 may be clamped to the carrier. In one example, the clamps may be fitted over a top portion of a baby carrier's armrest with the slots 1308 and 1316 holding the top of the armrests for a secure placement. Other types of fasteners may be used to secure the bottle holding system 1300 to the baby carrier. For example, nuts and bolts may be used.

Continuing with FIG. 13, the beam 1340 of the bottle holding system 1300 may be coupled to the first side member 1302 and the second side member 1310, which are parallel to one another. The beam 1340 may be welded to the first side member 1302 and the second side member 1310. Alternatively, the beam 1340 may be fastened to the first side member 1302 and the second side member 1310 but may be detached therefrom. Adhesives, nuts and bolts or the like may be used which may allow for the beam 1340 to be removed from the first side member 1302 and the second side member 1310.

The beam 1340 may extend from the first side member 1302 to the second side member 1310. The length of the beam 1340 may be adjusted based on the baby carrier, for example, the distance between the armrests. Furthermore, the beam 1340 may be adjusted vertically. In one embodiment, a vertical extension to the beam 1340 may be used.

The beam 1340 may include, but is not limited to, a first side section 1318, a second side section 1320 and a middle section 1322. The beam 1340 may be made of metal, plastic or the like. The first side section 1318 may be coupled to the first side member 1302 and the second side section 1320 may be coupled to the second side member 1310, where both couplings may be permanent or temporary as discussed above. Typically, the first side section 1318 and the second side section 1320 may be the same length.

Between the first side section 1318 and the second side section 1320 of the beam 1340 may be the middle section 1322. The middle section 1322 may be smaller, or larger, in diameter to increase or decrease the length of the beam 1340. For example, and when the diameter of the middle section 1322 is smaller, the first side section 1318 or the second side section 1320 may slide over the middle section 1322 thereby decreasing the length of the beam 1340. Oppositely, pulling the first side section 1318 or the second side section 1320 from the middle section 1322 may increase the length of the beam 1340. In one embodiment, the middle section 1322, after pulling the first side section 1318 or the second side section 1320 far enough, may completely disengage the first side section 1318 or the second side section 1320 splitting the beam 1340 into two.

In one embodiment, the beam 1340 may be a single component. The length of the beam 1340 may be increased or decreased through telescoping sections. For example, the beam 1340 may be permanently coupled to the first side member 1302 and the beam 1340 may be extended to the second side member 1310 through the telescoping sections. The beam 1340 may be connected to the second side member 1310 through a fastener as described above either permanently or temporarily.

The beam 1340 may support the first attachment 110. The first attachment 110 in turn may allow positioning and adjustments of the bottle 102, as described earlier. The attachment 110 may be supported at multiple locations along the beam 1340 and is not limited to the center of the beam 1340. The second attachment 710 may also be used and placed along different locations on the beam 1340.

The bottle holding system 1300 may be placed on the baby carrier after the baby 106 has been secured in accordance with one embodiment. Alternatively, the system 1300 may provide a pivot point, either on the first side member 1302 or the second side member 1310 such that the beam 1340 may be lifted from horizontally to vertically to remove or place in the baby 106 into the carrier. In one embodiment, the beam 1340 may be removed while the first side member 1302 and the second side member 1310 are secured to the baby carrier. The beam 1340 may then be refitted to another structure as described herein.

FIG. 14 is a closer view of a side section 1320 of the exemplary system 1300 for securing the bottle 102 to the baby carrier in accordance with one aspect of the present disclosure. The second side section 1320 may include an aperture 1402 that allows the middle section 1322, or a portion thereof, to enter into the second side section 1320. By allowing the middle section 1322 to enter into or exit out of the aperture 1402, the length of the beam 1340 may be decreased or increased. Similarly, the first side section 1318 may include an aperture that allows the middle section 1322, or a portion thereof, to enter or exit out of the first side section 1318 to decrease or increase the length of the beam 1340.

FIG. 15 is a closer view of a middle section 1322 of the exemplary system 1300 for securing the bottle 102 to the baby carrier in accordance with one aspect of the present disclosure. The middle section 1322 may enter or exit from the first side section 1318 or second side section 1320 to decrease or increase the length of the beam 1340. As shown, the middle section 1322 may have a smaller diameter than the first side section 1318 and the second side section 1320. Alternatively, the middle section 1322 may have a larger diameter than the first side section 1318 and the second side section 1320 to increase or decrease the length of the beam 1340.

To secure the middle section 1322 to the first side section 1318 and the second side section 1320, the middle section 1322 may include a first knob 1502 and second knob 1504. The knobs 1502 and 1504 may provide friction where the middle section 1322 does not move in and out of the first side section 1318 and the second side section 1320 easily. The knobs 1502 and 1504 may be characterized as slightly protruding from the middle section 1322. A material may be placed on the knobs 1502 and 1504 to increase the friction of the middle section 1322 from moving in and out easily. Other structures may be used such that the middle section 1322 does not easily become untethered from the first side section 1318 and the second side section 1320, for example, clasps or other fasteners.

Figure 16:
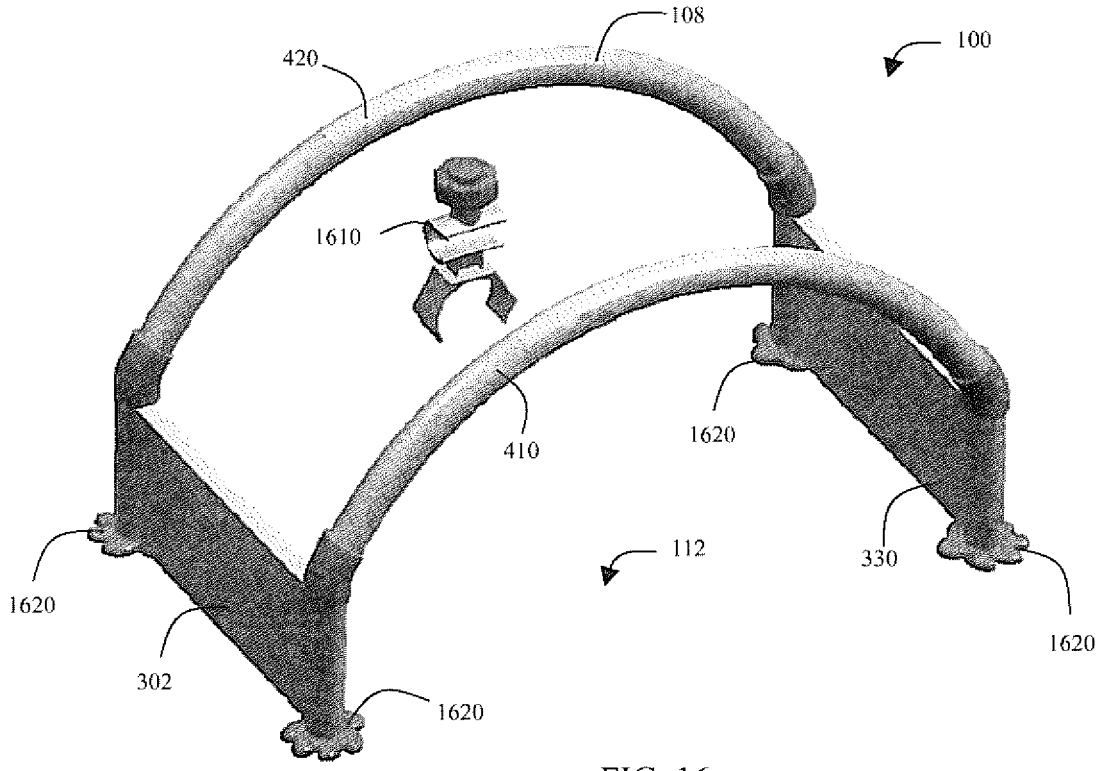
FIG. 16 is a top perspective view of another illustrative attachment for the exemplary system in accordance with one aspect of the present disclosure.

FIG. 16 is a top perspective view of another illustrative attachment 1610 for the exemplary system in accordance with one aspect of the present disclosure. The third attachment 1610 may be placed onto the previous systems 100 described above. The attachment 1610 may be placed on the structure 108 and supported by the first member 302 or second member 330. Similar to before, the structure 108 of the system 100 may include the first beam 410 and the second beam 420. The third attachment 1610 may be placed on the first beam 410, second beam 420 or the beam 1340 for the baby carrier. Furthermore, it may be placed on a variety of locations along these beams 410, 420 and 1340.

In one embodiment of the present disclosure, the structure 108 may include stabilizers 1620. The stabilizers 1620 may provide additional strength to the system 100. The stabilizers 1620 may be coupled to the first member 302 and second member 330. The stabilizers 1620 may be substantially flat such that they may make the system 100 hard to tip over when the structure 108 is placed on the ground 112. The stabilizers 1620 may come in a variety of shapes and forms and not limited to those disclosed herein.

Figure 17:
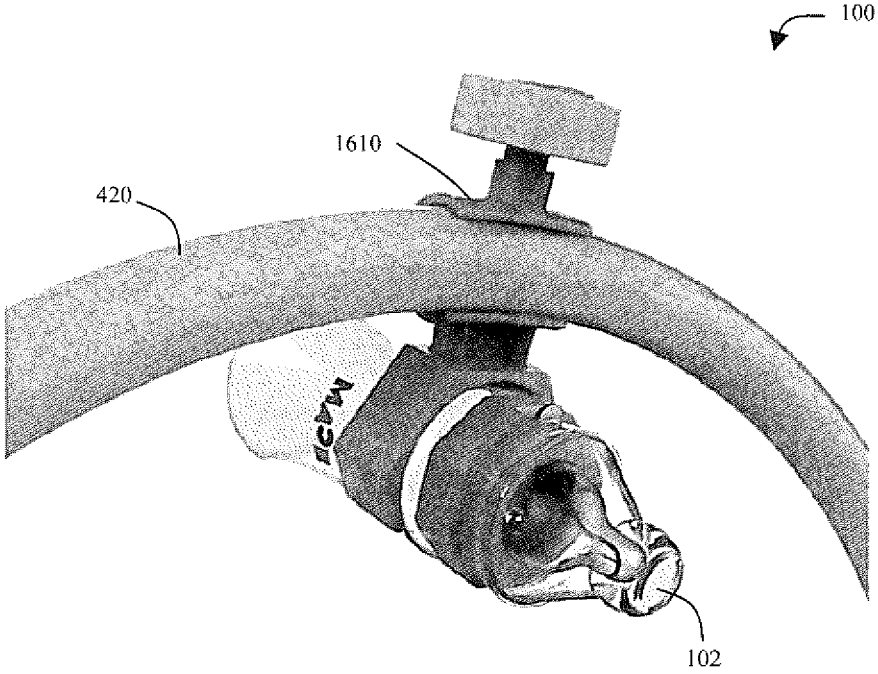
FIG. 17 is a side perspective view of the illustrative attachment for the exemplary system in accordance with one aspect of the present disclosure.

FIG. 17 is a side perspective view of the illustrative attachment 1610 for the exemplary system 100 in accordance with one aspect of the present disclosure. The third attachment 1610 may include an engaging section for a bottle 102. While shown as being placed on the second beam 420, the attachment 1610 may be placed on either of the beams 410, 420 and 1340 described above and is not limited to a centralized location.

Figure 18:
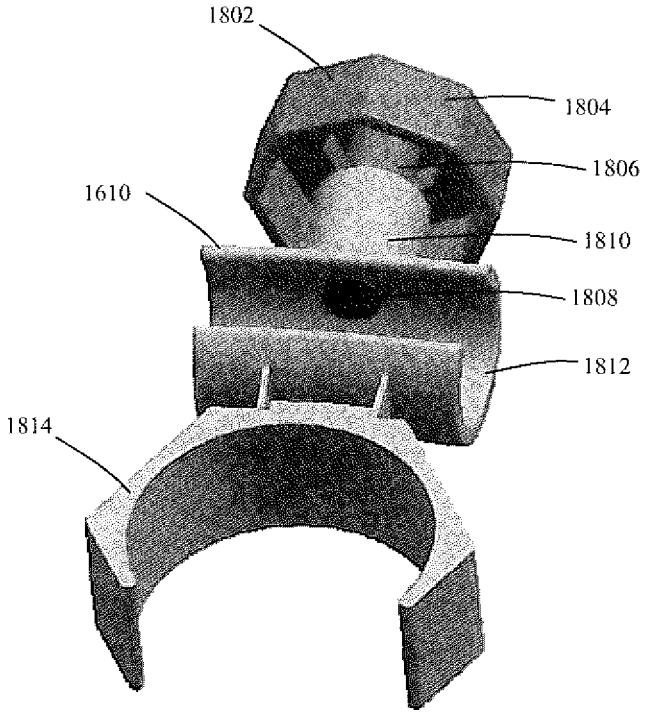
FIG. 18 is a closer perspective view of the illustrative attachment for the exemplary system in accordance with one aspect of the present disclosure.

FIG. 18 is a closer perspective view of the illustrative attachment 1610 for the exemplary system 100 in accordance with one aspect of the present disclosure. The third attachment 1610 may include, but is not limited to, a knob 1802, longitudinal cavity 1810, a clamp 1812 and a latch 1814 for securing the bottle 102. Fewer or more components may be used for the attachment 1610 and those provided below are for illustrative purposes.

The knob 1802 may include, but is not limited to, a handle 1804, cylindrical section 1806 and tightening portion 1808. The handle 1804 of the knob 1802 may allow a user to tighten and/or release the attachment 1610 to the structure 108. In one embodiment, turning the knob 1802 clockwise may tighten the attachment 1610 to the structure 108 while turning it counter-clockwise may release it.

The handle 1804 may extend outside the longitudinal cavity 1810 through the cylindrical section 1806. This section 1806 may be short or longer depending on the user. The section 1806 may pass through the longitudinal cavity 1810 and end at the tightening portion 1808. The tightening portion 1808 may be located on an interior of the clamp 1812. By turning the handle 1804 of the knob 1802, the longitudinal cylindrical section 1806 is driven in or out of the longitudinal cavity 1810 and the tightening portion 1808 is lowered or raised. In one embodiment, this may occur through a screw-like section on the cylindrical section 1806 and an opposite screw-like section within the longitudinal cavity 1810. Female or male threading may be used in the cylindrical section 1806 and longitudinal cavity 1810.

The longitudinal cavity 1810 and the clamp 1812 of the attachment 1610 may be incorporated into a single solid structure. In addition, the latch 1814 may be incorporated into this structure. Alternatively, each of these pieces may be coupled to one another and may be detachable.

The clamp 1812, as shown above, may be inserted over one of the previously described beams 410, 420 and 1340. The clamp 1812 may simply be pushed over the beams 410, 420 and 1340 making a tight fit that may secure the attachment 1610 to the structure 108. The tightening portion 1808 of the knob 1802 may secure the attachment 1610 to the beams 410, 420 and 1340 by turning the handle 1804 as described above. The attachment 1610 may be released by turning the handle 1804 in an opposite direction. The latch 1814 may provide the bottle engaging section.

Figure 19:
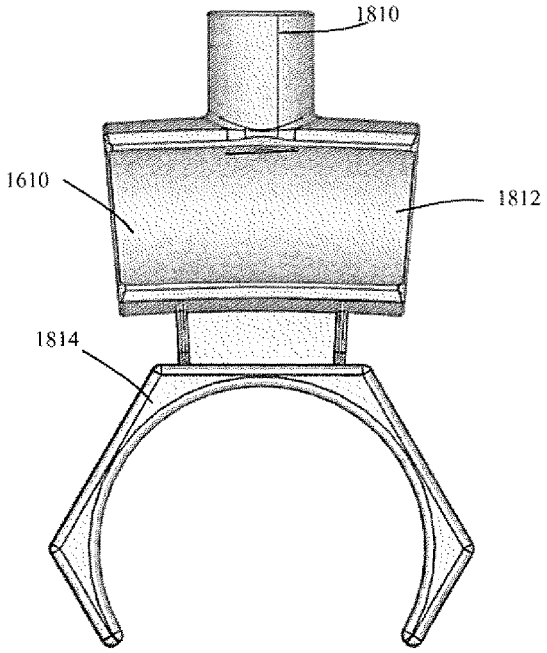
FIG. 19 is a side view of the illustrative attachment for the exemplary system without a knob in accordance with one aspect of the present disclosure.

FIG. 19 is a side view of the illustrative attachment 1610 for the exemplary system 100 without a knob 1802 in accordance with one aspect of the present disclosure. The attachment 1610, as described earlier, may include a longitudinal cavity 1810, clamp 1812 and latch 1814. The longitudinal cavity 1810 may allow the knob 1802 to tighten the attachment 1610 to the beams 410, 420 and 1340. In one embodiment, male or female screw-like threading may be provided within the cavity 1810.

The clamp 1812 of the third attachment 1610 may fit over the beams 410, 420 and 1340. The tightening portion 1808 of the knob 1802 when lowered may secure the attachment 1610 into the beams 410, 420 and 1340. The latch 1814 may secure the bottle 102 for feeding.

Figure 20:
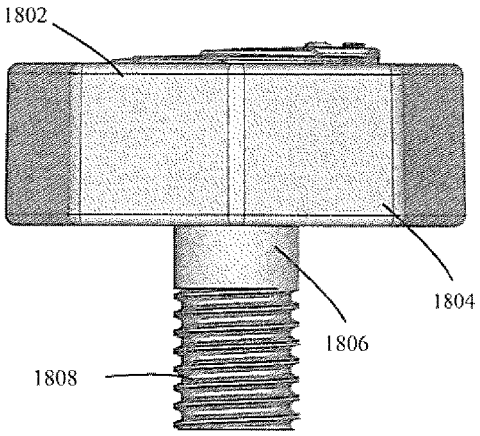
FIG. 20 is a side view of an illustrative knob in accordance with one aspect of the present disclosure.
Figure 22:
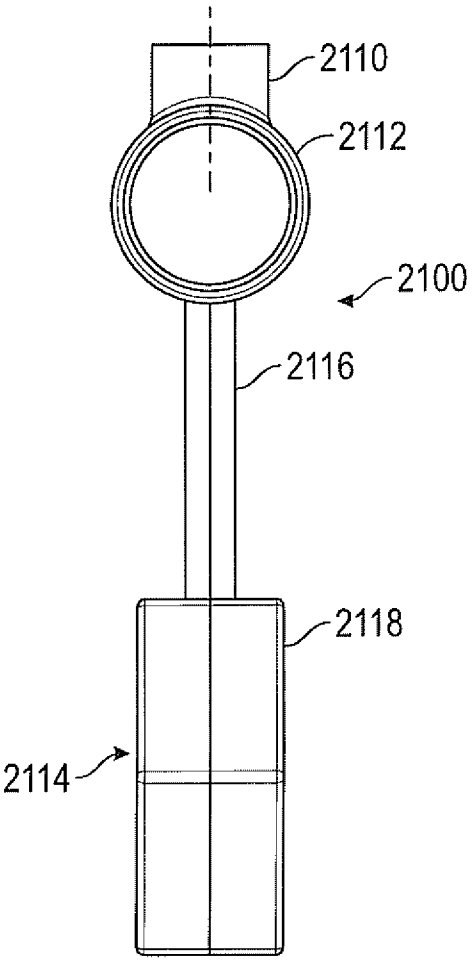
FIG. 22 is a side view of the illustrative attachment for the exemplary system without a knob in accordance with one aspect of the present disclosure.
Figure 21:
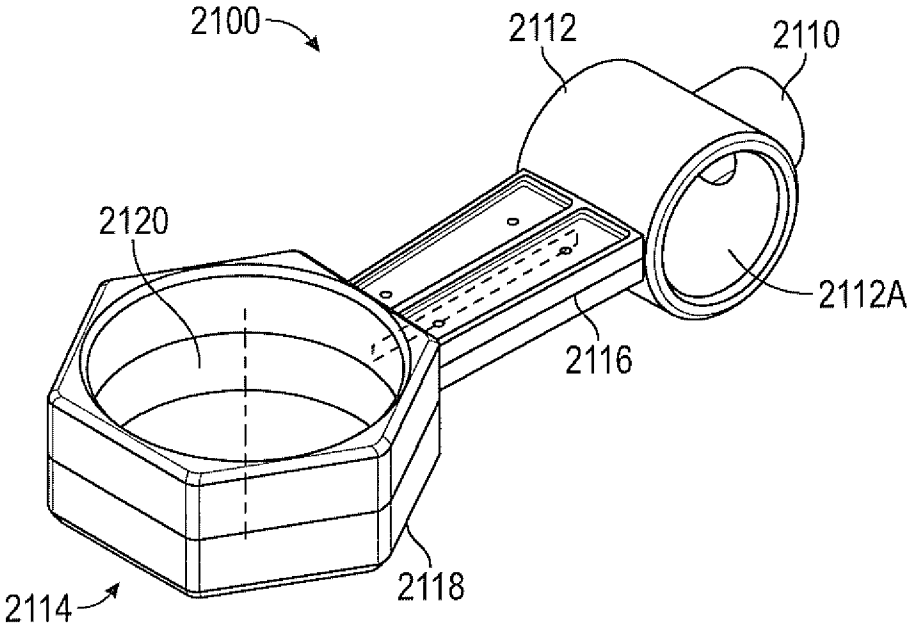
FIG. 21 is a perspective view of the illustrative attachment for the exemplary system in accordance with one aspect of the present disclosure.
Figure 24:
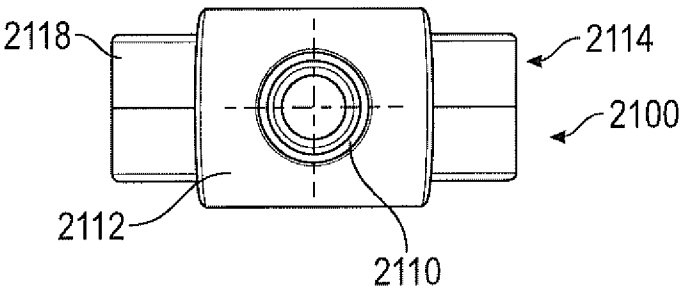
FIG. 24 is a rear view of the illustrative attachment for the exemplary system without a knob in accordance with one aspect of the present disclosure.
Figure 25:
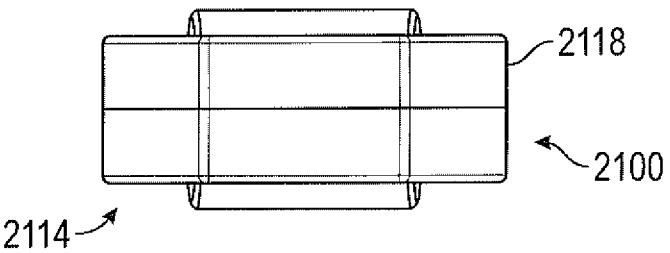
FIG. 25 is a front view of an illustrative knob in accordance with one aspect of the present disclosure.
Figure 23:
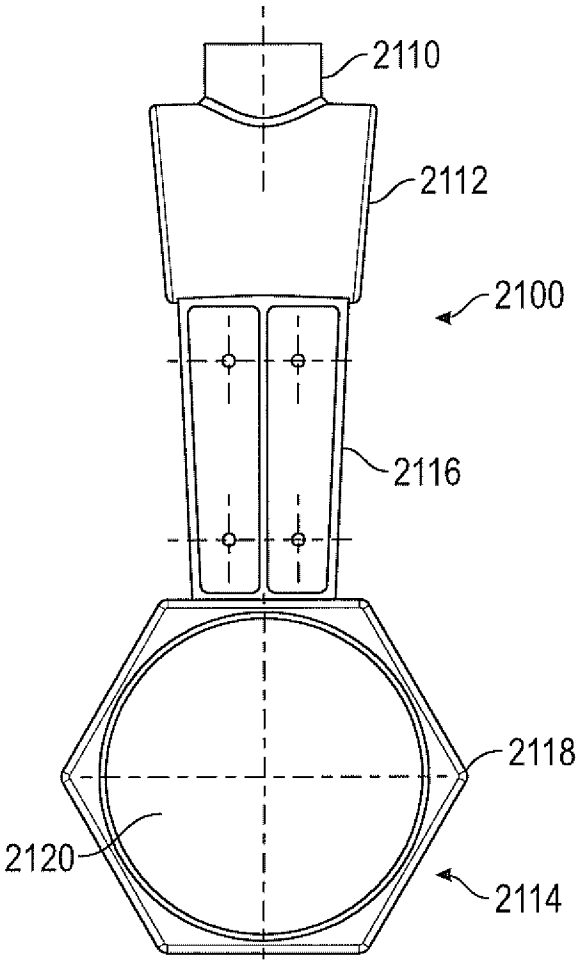
FIG. 23 is a top view of an illustrative knob in accordance with one aspect of the present disclosure.

FIG. 20 is a side view of an illustrative knob 1802 in accordance with one aspect of the present disclosure. The handle 1804 of the knob 1802 may include a geometric shape that allows a user to twist or turn the knob 1802. The twisting of the handle 1804 may lower or raise the cylindrical section 1806 up and down the longitudinal cavity 1810. As previously described, the raising and lowering of the cylindrical section 1806 may tighten the attachment 1610 through the tightening portion 1808 to the beams 410, 420 and 1340.

FIGS. 21-25 an illustrative attachment 2100 for the exemplary system 100 in accordance with one aspect of the present disclosure may be disclosed. The forth attachment 2100 may include an engaging section for a bottle 102. While shown as being placed on the second beam 420, the attachment 2100 may be placed on either of the beams 410, 420 and 1340 described above and is not limited to a centralized location.

The fourth attachment 2100 may include, but is not limited to, longitudinal cavity 2110, an attachment tube 2112, a support beam 2116 and a holder 2114 for securing the bottle 102. The longitudinal cavity 2110 may be coupled to the attachment tube 2112 such that the longitudinal cavity 2110 may be in communication with an interior of the attachment tube 2112. The attachment tube 2112 may have an inner diameter 2112A approximately equal to that of previously described beams 410, 420 and 1340. The support beam 2116 may be an approximately planer member. The support beam 2116 may extend from the attachment tube 2112 and is coupled to the holder 2114. The holder 2114 may be comprised of a base member 2118. An opening 2120 may be formed through the base member 2118. The opening 2120 may be of a size and shape to hold and secure a bottle 102 therein. The knob 1802 (FIGS. 18 and 20) may be positioned in the longitudinal cavity 2110 to secure the attachment 2100 to the beams 410, 420 and 1340 as may be described below. Fewer or more components may be used for the attachment 2100 and those provided below are for illustrative purposes.

The knob 1802 may include, but is not limited to, a handle 1804 (FIGS. 18 and 20), cylindrical section 1806 (FIGS. 18 and 20) and tightening portion 1808 (FIGS. 18 and 20). The handle 1804 of the knob 1802 may allow a user to tighten and/or release the attachment 2100 to the structure 108. In one embodiment, turning the knob 1802 clockwise may tighten the attachment 2100 to the structure 108 while turning it counter-clockwise may release it.

The handle 1804 may extend outside the longitudinal cavity 2110 through the cylindrical section 1806. This section 1806 may be short or longer depending on the user. The section 1806 may pass through the longitudinal cavity 2110 and end at the tightening portion 1808. The tightening portion 1808 may be located on an interior of the attachment tube 2112. By turning the handle 1804 of the knob 1802, the longitudinal cylindrical section 1806 is driven in or out of the longitudinal cavity 2110 and the tightening portion 1808 is lowered or raised. In one embodiment, this may occur through a screw-like section on the cylindrical section 1806 and an opposite screw-like section within the longitudinal cavity 2110. Female or male threading may be used in the cylindrical section 1806 and longitudinal cavity 2110.

Thus, to secure the attachment 2100, the user may turning the handle 1804 of the knob 1802 thereby driving the longitudinal cylindrical section 1806 out of the longitudinal cavity 2110 so that the tightening portion 1808 engages one of the beams 410, 420 and 1340 through which the attachment 2100 is coupled upon. To loosen the attachment 2100, the user may turning the handle 1804 of the knob 1802 in the opposite direction, thereby driving the longitudinal cylindrical section 1806 into the longitudinal cavity 2110 so that the tightening portion 1808 releases from the beams 410, 420 and 1340 through which the attachment 2100 is coupled upon.

The longitudinal cavity 2110, the attachment tube 2112, support beam 2116 and the holder 2114 of the attachment 2100 may be incorporated into a single solid structure. Alternatively, each of these pieces may be coupled to one another and may be detachable.

The attachment 2100 may be secured to one of the previously described beams 410, 420 and 1340 by inserting one of the previously described beams 410, 420 and 1340 through the attachment tube 2112. The tightening portion 1808 of the knob 1802 may secure the attachment 2100 to the beams 410, 420 and 1340 by turning the handle 1804 as described above. The attachment 2100 may be released by turning the handle 1804 in an opposite direction. Once secured, a user may inert a bottle 102 into the holder 2114.

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A bottle holding system for a baby device comprising:

a first rectangular section, a first hollow side end of the first rectangular section and a second hollow side end of the first rectangular section being on opposing side ends of the first rectangular section;

a second rectangular section running parallel to the first rectangular section, a first hollow side end of the second rectangular section and a second hollow side end of the second rectangular section being on opposing side ends of the second rectangular section;

a pair of stabilizers attached to opposing bottom ends on both the first rectangular section and the second rectangular section, each stabilizer of the pair of stabilizers being flat preventing the bottle holding system from tipping over when positioned on a ground;

a first arched beam removable inserted into the first hollow side end of the first rectangular section and the first hollow side end of the second rectangular section, a first rod of the first arched beam extending from the first hollow side end of the first rectangular section and having a first connector point extending from a distal end of the first rod of the first arched beam, a second rod of the first arched beam extending from the first hollow side end of the second rectangular section and having a second connector point formed on a distal end of the second rod of the first arched beam, the first connector point of the first rod of the first arched beam engaging the second connector point of the second rod of the first arched bears to secure the first rod of the first arched beam to the second rod of the first arched beam;

a second arched beam removably inserted into the second hollow side end of the first rectangular section and the second hollow side end of the second rectangular section, a first rod of the second arched beam extending from the second hollow side end of the second rectangular section and having a first connector point extending from a dista end of the first rod of the second arched beam, a second rod of the second arched beam extending from the second hollow side end of the first rectangular section and having a second connector point formed on a distal end of the second rod of the second arched beam, the first connector point of the first rod of the second arched beam engaging the second connector point of the second rod of the second arched beam to secure the first rod of the second arched beam to the second rod of the second arched beam; and the second arched beam inserted through an attachment and securing a bottle to the second arched beam, the attachment being adjustable to secure the bottle at different levels, wherein the attachment comprises:

an attachment tube;

a longitudinal cavity coupled to the attachment tube and in communication with an interior of the attachment tube; and a holder coupled to the attachment tube securing the bottle;

wherein the second arched beam is positioned within the attachment tube securing the attachment to the second arched beam.

2. The bottle holding system of claim 1, comprising a knob device, the knob device running through the longitudinal cavity engaging the second arch beam securing the attachment position on the second arched beam.

3. The bottle holding system of claim 2, comprising a support beam coupled between the attachment tube and the holder.

4. The bottle holding system of claim 1, herein the holder comprises:

a base member; and an opening formed in the base member.

5. The bottle holding system of claim 4, wherein the opening has e perimeter approximately a same size and shape of the bottle.

6. The bottle holding system of claim 1, wherein the first arched beam and the second arched beam are adjustable in length.

7. The bottle holding system of claim 6, wherein the first connector point of the first rod of the first arched beam and the first connector point of the first rod of the second arched beam re male connector movable within the second connector point of the second rod of the first arched beam and the second connector point of the second rod of the second arched beam respectively which are female connectors allowing the first ached beam and the second ached beam to be adjustable in length.

8. The bottle holding system of claim 1, wherein the first rectangular section and the second rectangular section are a height taller than a user of the bottle holding system laying on the ground.

9. The bottle holding system of claim 1, wherein the first rectangular section and the second rectangular section are of height to provide clearance of the bottle above the ground at all of the different levels adjusted by the attachment.

10. A bottle holding system for a baby device comprising:

a first rectangular section, a first hollow side end of the first rectangular section and a second hollow side end of the first rectangular section being on opposing side ends of the first rectangular section;

a second rectangular section running parallel to the first rectangular section, a first hollow side end of the second rectangular section and a second hollow side end of the second rectangular section being on opposing side ends of the second rectangular section;

a pair of stabilizers attached to opposing bottom ends on both the first rectangular section and the second rectangular section, each stabilizer of the pair of stabilizers being flat preventing the bottle holding system from tipping over when positioned on a ground;

a first arched beam removably inserted into the first hollow side end of the first rectangular section and the first hollow side end of the second rectangular section, a first rod of the first arched beam extending from the first hollow side end of the first rectangular section and having a first connector point extending from a distal end of the first rod of the first arched beam, a second rod of the first arched beam extending from the first hollow side end of the second rectangular section and having a second connector point formed on a distal end of the second rod of the first arched beam, the first connector point of the first rod of the first arched beam engaging the second connector point of the second rod of the first arched beam to secure the first rod of the first arched beam to the second rod of the first arched beam;

a second arched beam removably, inserted into the second hollow side end of the first rectangular section and the second hollow side end of the second rectangular section, a first rod of the second arched beam extending from the second hollow side end of the second rectangular section and hang a first connector point extending from a distal end of the first rod of the second arched beam, a second rod of the second arched beam extending from the second hollow side end of the first rectangular section and having a second connector point formed on a distal end of the second rod of the second arched beam, the first connector point of the first rod of the second arched beam engaging the second connector point of the second rod of the second arched beam to secure the first rod of the second arched beam to the second rod of the second arched beam;

the second arched beam inserted through an attachment and securing a bottle to the second arched beam, the attachment being adjustable to secure the bottle at different levels, the attachment comprising:

an attachment tube, the second arched beam positioned within the attachment tube;

a longitudinal cavity coupled to the attachment tube and in communication with an interior of the attachment tube;

a base member;

an opening formed in the base member, wherein the opening has a perimeter approximately a same size and shape of the bottle;

a support beam attached between the attachment tube and the base member; and a knob engaging the longitudinal cavity securing the attachment to the second arched beam;

wherein the first rectangular section and the second rectangular section are a height taller than a user of the bottle holding system laying on the ground.

11. The bottle holding system of claim 10, wherein the first arched beam and the second arched beam are adjustable in length.

12. The bottle holding system of claim 10, wherein the first connector point of the first rod of the first arched beam and the first connector point of the first rod of the second arched beam are male connector movable within the second connector point of the second rod of the first arched beam and the second connector point of the second rod of the second arched beam respectively which are female connectors allowing the first ached beam and the second ached beam to be adjustable in length.

* * * * *